US011982061B2

(12) United States Patent
Mielenz

(10) Patent No.: US 11,982,061 B2
(45) Date of Patent: May 14, 2024

(54) METHOD FOR OPERATING A CLEANING VEHICLE

(71) Applicant: Robert Bosch GmbH, Stuttgart (DE)

(72) Inventor: Holger Mielenz, Ostfildern (DE)

(73) Assignee: ROBERT BOSCH GMBH, Stuttgart (DE)

( * ) Notice: Subject to any disclaimer, the term of this patent is extended or adjusted under 35 U.S.C. 154(b) by 329 days.

(21) Appl. No.: 17/420,799

(22) PCT Filed: Dec. 17, 2019

(86) PCT No.: PCT/EP2019/085635
§ 371 (c)(1),
(2) Date: Jul. 6, 2021

(87) PCT Pub. No.: WO2020/144011
PCT Pub. Date: Jul. 16, 2020

(65) Prior Publication Data

US 2022/0112672 A1 Apr. 14, 2022

(30) Foreign Application Priority Data

Jan. 8, 2019 (DE) ..... 102019200144.0

(51) Int. Cl.
*E01H 1/05* (2006.01)
*E01H 1/00* (2006.01)

(52) U.S. Cl.
CPC ..... *E01H 1/056* (2013.01); *E01H 1/005* (2013.01)

(58) Field of Classification Search
None
See application file for complete search history.

(56) References Cited

FOREIGN PATENT DOCUMENTS

| | | | |
|---|---|---|---|
| CN | 101126227 | A | 2/2008 |
| CN | 103696381 | A | 4/2014 |
| CN | 105544440 | A | 5/2016 |
| CN | 105862635 | A | 8/2016 |
| CN | 107366248 | A | 11/2017 |
| CN | 107447717 | A | 12/2017 |
| CN | 207062858 | U | 3/2018 |

(Continued)

OTHER PUBLICATIONS

CN 105862635 translation (Year: 2023).*

(Continued)

*Primary Examiner* — Eric W Golightly
(74) *Attorney, Agent, or Firm* — NORTON ROSE FULBRIGHT US LLP; Gerard A. Messina

(57) ABSTRACT

A method for the operation of a cleaning vehicle, in particular a street sweeper capable of being operated in automated fashion, by a control device. A trajectory is calculated and control commands are produced for a longitudinal guiding and transverse guiding of the cleaning vehicle during travel of the calculated trajectory. Measurement data are received from at least one sensor in order to ascertain a cleaning region. At least one actuator is controlled, based on the received measurement data, in order to position a cleaning device of the cleaning vehicle in the longitudinal direction and/or transverse direction relative to a direction of travel of the cleaning vehicle, in order to clean the cleaning region. A control device, a computer program, and a machine-readable storage medium are also described.

11 Claims, 2 Drawing Sheets

(56) References Cited

FOREIGN PATENT DOCUMENTS

| | | | | | |
|---|---|---|---|---|---|
| CN | 107948501 | A | * | 4/2018 | ..... G06T 15/00 |
| CN | 108289584 | A | | 7/2018 | |
| CN | 108803599 | A | | 11/2018 | |
| DE | 202011001005 | U1 | | 8/2011 | |
| GB | 2534265 | A | | 7/2016 | |

OTHER PUBLICATIONS

CN 107948501A translation (Year: 2023).*
International Search Report for PCT/EP2019/085635, dated Apr. 15, 2020, 2 pages.

* cited by examiner

METHOD FOR OPERATING A CLEANING VEHICLE

FIELD

The present invention relates to a method for operating a cleaning vehicle, in particular a street sweeper that can be operated in an automated manner, a control device, a computer program, and a machine-readable storage medium.

BACKGROUND INFORMATION

Driven street sweepers for cleaning roadways and sidewalks are currently in use. Such street sweepers are standardly made up of a vehicle and a cleaning device. The cleaning device can be moved relative to the vehicle, and is used to pick up soilings. The soilings can be for example dirt, leaves, stones, or garbage.

Usually, the position of the cleaning device relative to the vehicle is set at the front end. The driver then regulates the position of the cleaning device to the position of the soiling through the longitudinal and transverse guiding of the vehicle. For this purpose, the vehicle standardly has a manual vehicle steering apparatus that is positioned at a side of the vehicle oriented at the side of the edge of the roadway.

SUMMARY

An object of the present invention is to provide a method and a control device for the optimal cleaning of the roadway surface up to the boundaries of the roadway surface.

This object may be achieved by example embodiments of the present invention. Advantageous embodiments of the present invention are disclosed herein.

According to an aspect of the present invention, a method is provided for operating a cleaning vehicle, in particular a street sweeper capable of being operated in automated fashion. The method can in particular be carried out by a control device.

In accordance with an example embodiment of the present invention, in a step, a trajectory is calculated. Here, control commands are produced for longitudinal and transverse guiding of the cleaning vehicle during travel of the calculated trajectory. The longitudinal and transverse guiding of the cleaning vehicle can be realized by actuators of the cleaning vehicle, and a controlling of the actuators by the control device.

Measurement data are received by the control device from at least one sensor in order to ascertain a cleaning region. For this purpose, the control device can be connected to the at least one sensor in data-conducting fashion directly or via an interface.

In a further step, for the positioning of a cleaning device of the cleaning vehicle for the cleaning of the cleaning region, based on the received measurement data at least one actuator is controlled in the longitudinal direction and/or transverse direction relative to a direction of travel of the cleaning vehicle.

According to a further aspect of the present invention, a control device is provided for operating a cleaning vehicle. In accordance with an example embodiment of the present invention, the control device is connectable to at least one sensor for evaluating measurement data, the control device being set up to carry out the method.

In addition, according to an aspect of the present invention a computer program is provided that includes commands that, when the computer program is executed by a computer or a control device, cause this computer or control device to carry out the method according to the present invention.

According to a further aspect of the present invention, a machine-readable storage medium is provided on which the computer program according to the present invention is stored.

Through the method and the control device, a cleaning vehicle capable of being operated in automated fashion can be controlled. Here, a trajectory can be calculated by the control device. Preferably, the trajectory corresponds to a path segment that is to be cleaned. The cleaning vehicle is guided along a roadway edge and/or along the cleaning region by an environmental sensor system.

Preferably, the trajectory of the vehicle can act as a rough guiding or positioning of the cleaning device of the cleaning vehicle. The controlling of the actuators can here enable a fine orientation of the cleaning device.

The fine orientation of the cleaning device takes place in such a way that a lateral roadway edge is optimally cleaned by cleaning tools of the cleaning device.

For example, an optimal cleaning of a flat roadway edge can be realized by an overlapping in some regions of the roadway edge by a rotating brush. In the case of a curbstone as roadway edge, optimal cleaning results can be realized when there is an at least slight counter-pressure of the at least one rotating brush against the curb.

Here, the lateral roadway edge can be detected, in the form of a cleaning region, by the at least one sensor. The at least one sensor can be a sensor of the cleaning device and/or a sensor of the cleaning vehicle.

The at least one sensor can be a lidar sensor, a radar sensor, a video sensor, a camera sensor, an ultrasound sensor, and the like.

In accordance with an example embodiment of the present invention, the cleaning device can have at least one cleaning tool. The at least one cleaning tool can be a rotating brush, pressurized air nozzle, pressurized water nozzle, shovel, suction device, and the like. The at least one cleaning tool and/or the overall cleaning device can be capable of being oriented by the actuator. The actuator can be driven hydraulically, pneumatically, or electrically. The cleaning tools can also be drivable hydraulically, pneumatically, or electrically. The cleaning tools can be positioned as a unit or individually.

The cleaning vehicle can be realized as a vehicle that can be operated in automated and/or in partly automated fashion. In particular, the cleaning vehicle can be capable of being operated, according to the SAE J3016 norm, in partly automated fashion, automated fashion with limited conditions, highly automated fashion, and/or fully automated, or driverless, fashion. The cleaning vehicle can be realized as a street sweeper.

Through the method, a path planning for the automated cleaning vehicle can be realized in such a way that the brushes, or the overall cleaning device of the street sweeping machine, optimally acquire the lateral roadway edge. The trajectories can be calculated ahead of time in such a way that they at least approximately map the geometry of the roadway edge boundary. In particular, the cleaning of the cleaning region up to the boundaries of the roadway surface can be enabled.

In accordance with an example embodiment of the present invention, the control device of the cleaning device and/or of the cleaning vehicle can have one or more algorithms for controlling the longitudinal and transverse guiding of the cleaning vehicle on the basis of the calculated trajectories.

According to a specific embodiment of the present invention, the cleaning device is activated or deactivated as a function of the ascertained cleaning region. In this way, the cleaning vehicle can be operated particularly efficiently. In particular, the cleaning device can first be oriented and then put into operation in order to remove soiling of a roadway or sidewalk.

According to a further specific embodiment of the present invention, a positioning of the cleaning device is carried out by the longitudinal and transverse guiding of the cleaning vehicle and/or by the at least one actuator. Here, in addition to the automated controlling of the cleaning vehicle, a controlling of the cleaning device is provided that is independent of the vehicle, or is dependent on the vehicle at least in some regions. A rough positioning of the cleaning device can be carried out by the steering, or orientation, of the cleaning vehicle, and a fine or final positioning of the cleaning device can be carried out by the at least one actuator of the cleaning device. Through the controlling of the actuator, a situation-dependent adaptation of the cleaning device to a roadway edge or to a soiling can be enabled. The positioning of the cleaning device can include the overall cleaning device or the positioning of individual cleaning tools. In particular, the positioning of the cleaning device can take place more quickly than a rough positioning of the cleaning device via the orientation of the vehicle along the calculated trajectory.

According to a further exemplary embodiment of the present invention, the positioning of the cleaning device is carried out by the control device in such a way that a portion of the longitudinal and/or transverse guiding of the cleaning vehicle in the positioning of the cleaning device is minimal. In this way, the control outlay, or the regulation outlay, for realizing the transverse guiding of the cleaning vehicle can be reduced. In particular, deviations of the roadway edge from the calculated trajectory can be compensated by adjusting or adapting the position of the cleaning device.

According to a further exemplary embodiment of the present invention, the positioning of the cleaning device is carried out by the longitudinal and transverse guiding of the cleaning vehicle and/or by the at least one actuator based on an algorithm of the control device. The algorithm can preferably generate a working region, or cleaning region, from an intended trajectory of the cleaning vehicle.

Here, a portion of the positioning of the at least one cleaning tool transverse to the direction of travel of the vehicle can be realized by positioning the vehicle, and a portion can be realized by positioning the cleaning device or by controlling the actuator.

According to a further exemplary embodiment of the present invention, the measurement data are used by the control device to ascertain a position of the cleaning region, in the form of a soiling or a roadway edge. In this way, the position of the region to be cleaned can be ascertained by the at least one sensor. The position of the cleaning region can be realized in the form of a curve.

The curve of the cleaning region can for example follow a roadway curve or can deviate from the roadway curve. In addition, the cleaning region can be a function of a curve of a roadway edge. For example, exits and correspondingly lowered curbs may interrupt or modify a cleaning region. Changing roadway edges may also cause a change in the cleaning region.

In particular, at least one roadway edge can be detected by the at least one sensor. Here, the measurement data of the sensor can be used to adjust or orient the cleaning device to the detected roadway edge. The roadway edge can be formed here by curbstones or gutter stones. In addition, the roadway edge may be defined by flat boundaries, such as line markings, differences in texture, cobblestones, yards, and the like.

The corresponding roadway edge can be detected for example by optical sensors. In particular, a distance between the roadway edge and the cleaning vehicle can be ascertained by the control device, and the position of the cleaning device can be set corresponding to the distance, whereby for example the cleaning brushes at least partly overlap the roadway edge, or meet the roadway edge so as to fit its shape.

According to a further specific embodiment of the present invention, the measurement data for ascertaining the position of the cleaning region are ascertained by the at least one sensor and/or by at least one environmental sensor of the cleaning vehicle. The cleaning vehicle can here have an environmental sensor system in order to perceive the drivable roadway, other traffic participants, dynamic and static objects, pedestrians, traffic regulations, and the like. For example, the cleaning vehicle can have radar sensors, lidar sensors, camera sensors, GPS sensors, and the like. In this way, the cleaning vehicle can travel a calculated trajectory in automated fashion.

The environmental sensor system of the cleaning vehicle can be used alternatively or in addition to the at least one sensor in order to detect a roadway edge and to carry out a corresponding positioning or orientation of the cleaning device.

According to a further specific embodiment of the present invention, the cleaning device is situated relative to the cleaning vehicle as a function of a type of the ascertained cleaning region. In this way, a fine adjustment of the position of the cleaning device by the control device can be carried out, through which an optimized cleaning of the roadway edge is possible. In particular, the optimized cleaning can also be adapted quickly and flexibly to different and changing roadway edges.

Via the known dimensions of the vehicle, including the cleaning instruments or the cleaning tools, from a current standpoint a trajectory can be calculated that complies with traffic regulations and makes it possible, for example in the case of flat roadway boundaries, for the cleaning instruments to completely cover these, and in the case of raised boundaries for the cleaning instruments to be guided directly at the boundary of the roadway edge.

In addition, as a function of the ascertained roadway edge one or more defined cleaning instruments of the cleaning device can be used to clean the cleaning region.

In the following, preferred exemplary embodiments of the present invention are explained in more detail on the basis of greatly simplified schematic representations.

DETAILED DESCRIPTION OF EXAMPLE EMBODIMENTS

Figure 1:
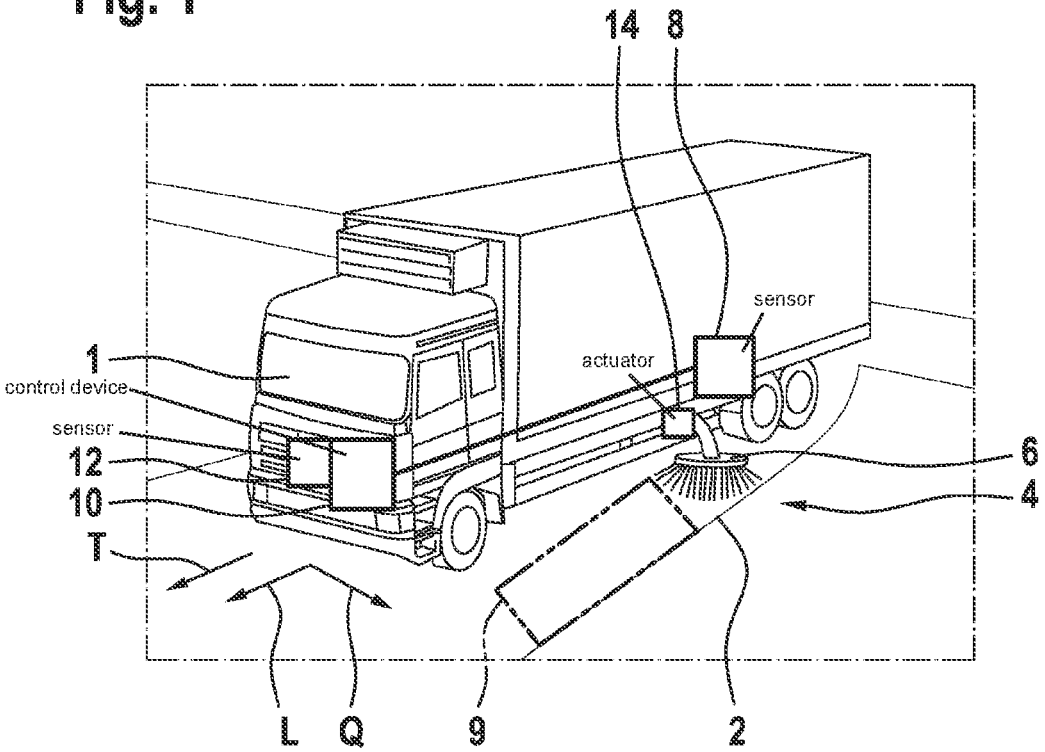
FIG. 1 shows a schematic representation of a cleaning vehicle illustrating the method for the case of a flat roadway boundary, according to a specific embodiment of the present invention.

FIG. 1 shows a schematic representation of a cleaning vehicle 1 illustrating the method for the case of a flat roadway boundary 2, according to a specific embodiment of the present invention.

Cleaning vehicle 1 is realized as a large street sweeper, and has a cleaning device 4. In the Figure, a cleaning tool 6 of cleaning device 4 is shown. Cleaning tool 4 is realized as a rotating brush.

Cleaning device 4 has a sensor 8. Sensor 8 is a lidar sensor acting in two dimensions that can scan roadway edge 2. Through sensor 8, a relative distance can be measured, in transverse direction Q, between cleaning vehicle 1 and roadway edge 2. In addition, the type of roadway edge 2 can be ascertained on the basis of measurement values of sensor 8.

In addition to roadway edge 2, a cleaning region 9 is ascertained using the measurement data of sensor 8. Cleaning region 9 is a region that is cleaned by cleaning tool 6 in the course of trajectory T.

Sensor 8 is connected in data-conducting fashion to a control device 10 of cleaning vehicle 1. In addition, at least one further sensor 12 is connected in data-conducting fashion to control device 10. Sensor 12 is a camera sensor and is realized as an environmental sensor 12 of cleaning vehicle 1. With the aid of environmental sensor 12, cleaning vehicle 1 can be guided along a trajectory T by control device 10.

While cleaning vehicle 1 is guided or steered along trajectory T, sensor 8 detects roadway edge 2 and the distance of cleaning tool 6 from roadway edge 2. Control device 10 here generates, as a function of the received measurement data from sensor 8, control commands for controlling an actuator 14. Using actuator 14, the position of rotating brush 6 can be adjusted in order to achieve an optimal cleaning result.

According to the exemplary embodiment of the present invention, an optimal position of rotating brush 6 is set. Here, rotating brush 6 overlaps flat roadway edge 2, here realized as a roadway marking.

Figure 2:
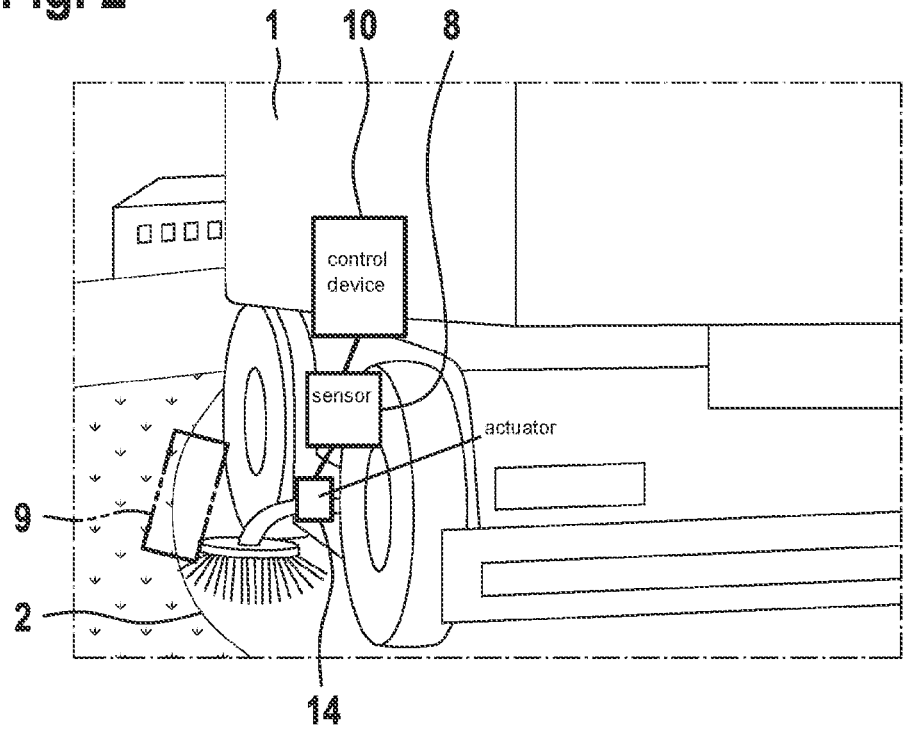
FIG. 2 shows a schematic representation of a cleaning vehicle illustrating the method for the case of a flat roadway boundary, according to a further specific embodiment of the present invention.

FIG. 2 shows a schematic representation of a cleaning vehicle 1 illustrating the method for the case of a flat roadway boundary 2, according to a further specific embodiment. Differing from the exemplary embodiment shown in FIG. 1, here roadway boundary 2 is realized in the form of the edge of a lawn.

The lawn edge and its position are detected here by sensor 8, and cleaning tool 6 is set by actuator 14 to the position shown in FIG. 2.

Figure 3:
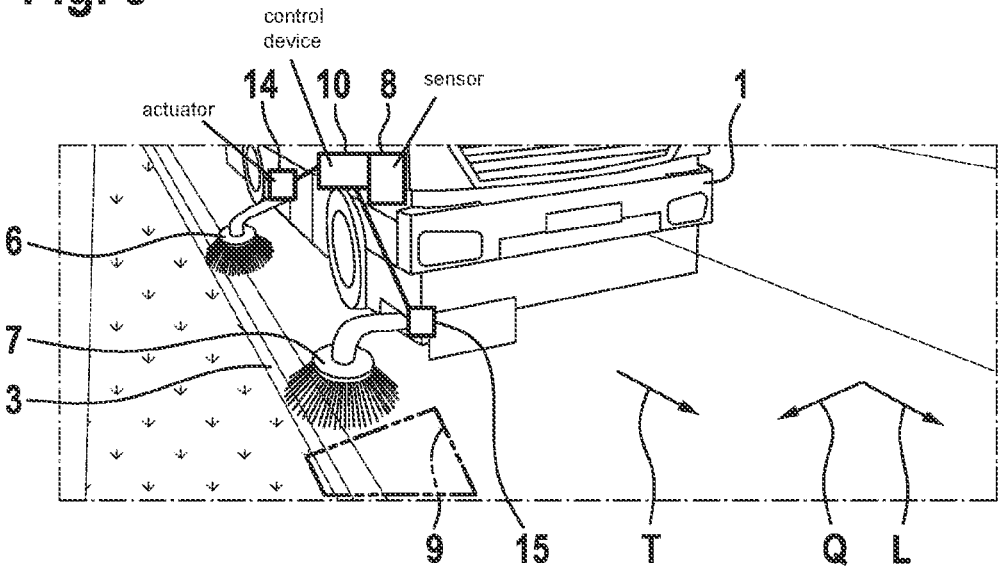
FIG. 3 shows a schematic representation of a cleaning vehicle illustrating the method for the case of a curbstone as roadway boundary, according to a specific embodiment of the present invention.

FIG. 3 shows a further schematic representation of a cleaning vehicle 1 illustrating the method for the case of a curbstone 3 as an uneven roadway boundary 3, according to a specific embodiment of the present invention.

Differing from the above-described exemplary embodiments, cleaning vehicle 1 has a cleaning device 4 having two cleaning tools 6, 7. Cleaning tools 6, 7 are realized as rotating brushes 6, 7. A first rotating brush 6 is situated in the longitudinal direction L between the wheels, laterally on cleaning vehicle 1, and is adjustable in its position via a first actuator 14.

A second rotating brush 7 is situated in the direction of travel, or longitudinal direction L, of cleaning vehicle 1, in front of vehicle 1, and can be adjusted in its position via a second actuator 15.

Actuators 14, 15 are both connected to control device 10 in such a way that, based on measurement data of sensor 8, control device 10 can adjust the positions of cleaning tools 6, 7 independently of one another.

Here, the position of first brush 6 is set in such a way that a surface of curbstone 3 that is at the road, i.e. is lower, is cleaned. Second brush 7 has a position that is optimal for cleaning that is set higher than the position of first brush 6. In this way, second brush 7 cleans an upper surface, or a side away from the roadway, of curbstone 3. Through the depicted configuration of cleaning tools 6, 7, an optimal cleaning of curbstone 3 can be realized in automated fashion.

What is claimed is:

1. A method for operating a cleaning vehicle that is operable in an automated manner by a control device, the method comprising:

calculating a trajectory, and producing control commands for longitudinally guiding and transversely guiding the cleaning vehicle during travel of the calculated trajectory;

receiving measurement data from at least one sensor to ascertain a cleaning region; and controlling at least one actuator, based on the received measurement data, to position a cleaning device of the cleaning vehicle in a longitudinal direction and/or transverse direction relative to a direction of travel of the cleaning vehicle, to clean the cleaning region;

wherein the cleaning device is positioned relative to the cleaning vehicle by the at least one actuator as a function of a type of the ascertained cleaning region.

2. The method as recited in claim 1, wherein the cleaning vehicle is a street sweeper.

3. The method as recited in claim 1, wherein the cleaning device is activated or deactivated as a function of the ascertained cleaning region.

4. The method as recited in claim 1, wherein a positioning of the cleaning device is carried out through the longitudinal guiding and the transverse guiding of the cleaning vehicle and/or by the at least one actuator.

5. The method as recited in claim 4, wherein the positioning of the cleaning device is carried out by the control device so that a portion of the longitudinal guiding and/or the transverse guiding of the cleaning vehicle in the positioning of the cleaning device is minimal.

6. The method as recited in claim 4, wherein the positioning of the cleaning device is carried out through the longitudinal guiding and the transverse guiding of the cleaning vehicle, and/or by the at least one actuator, based on an algorithm of the control device.

7. The method as recited in claim 1, wherein the measurement data are used by the control device for ascertaining a position of the cleaning region, in a form of a soiling edge or a roadway edge.

8. The method as recited in claim 7, wherein the measurement data for the ascertaining of the position of the cleaning region is ascertained by the at least one sensor and/or by at least one environmental sensor of the cleaning vehicle.

9. The method as recited in claim 1, wherein at least one travelable roadway, and/or other traffic participants, and/or dynamic objects, and/or static objects, and/or pedestrians, and/or traffic regulations are ascertained by the at least one sensor and/or by at least one environmental sensor of the cleaning vehicle.

10. A control apparatus for operating a cleaning vehicle, comprising:

a control device connectable to at least one sensor for evaluating measurement data, wherein the control device is configured to perform the following:

calculating a trajectory and producing control commands for longitudinally guiding and transversely guiding the cleaning vehicle during travel of the calculated trajectory;

receiving measurement data from the at least one sensor to ascertain a cleaning region; and controlling at least one actuator, based on the received measurement data, to position a cleaning device of the cleaning vehicle in a longitudinal direction and/or transverse direction relative to a direction of travel of the cleaning vehicle, to clean the cleaning region;

wherein the cleaning device is positioned relative to the cleaning vehicle by the at least one actuator as a function of a type of the ascertained cleaning region.

11. A non-transitory machine-readable storage medium, on which is stored a computer program, which is executable by a processor, comprising:

a program code arrangement having program code for operating a cleaning vehicle that is operable in an automated manner by a control device having the processor, for performing the following:

calculating a trajectory and producing control commands for longitudinally guiding and transversely guiding the cleaning vehicle during travel of the calculated trajectory;

receiving measurement data from at least one sensor to ascertain a cleaning region; and controlling at least one actuator, based on the received measurement data, to position a cleaning device of the cleaning vehicle in a longitudinal direction and/or transverse direction relative to a direction of travel of the cleaning vehicle, to clean the cleaning region;

wherein the cleaning device is positioned relative to the cleaning vehicle by the at least one actuator as a function of a type of the ascertained cleaning region.

* * * * *